US010504669B2

(12) United States Patent
Motoi

(10) Patent No.: US 10,504,669 B2
(45) Date of Patent: Dec. 10, 2019

(54) DISPLAY DEVICE AND MANIPULATION SWITCH EQUIPPED WITH IT

(71) Applicant: ALPS ALPINE CO., LTD., Ota-ku, Tokyo (JP)

(72) Inventor: Hiromi Motoi, Tokyo (JP)

(73) Assignee: ALPS ALPINE CO., LTD., Tokyo (JP)

( * ) Notice: Subject to any disclaimer, the term of this patent is extended or adjusted under 35 U.S.C. 154(b) by 17 days.

(21) Appl. No.: 15/451,488

(22) Filed: Mar. 7, 2017

(65) Prior Publication Data

US 2017/0256370 A1 Sep. 7, 2017

(30) Foreign Application Priority Data

Mar. 7, 2016 (JP) ..... 2016-043919

(51) Int. Cl.
*H01H 13/02* (2006.01)

(52) U.S. Cl.
CPC ..... *H01H 13/023* (2013.01)

(58) Field of Classification Search
CPC ..... H01H 13/023; H01H 9/182; H01H 2219/056; H01H 2219/062; H01H 2229/046; H01H 2231/026
USPC ..... 362/23.04
See application file for complete search history.

(56) References Cited

U.S. PATENT DOCUMENTS 4,733,335 A * 3/1988 Serizawa ..... B60Q 1/302 362/503
5,878,870 A * 3/1999 Ohtaki ..... H01H 13/023 200/313
6,176,589 B1 1/2001 Ishiguro
2004/0182687 A1* 9/2004 Tsubaki ..... H01H 3/12 200/341
2014/0197015 A1* 7/2014 Ikeuchi ..... H01H 13/023 200/314

* cited by examiner

*Primary Examiner* — Britt D Hanley
*Assistant Examiner* — Jessica M Apenteng
(74) *Attorney, Agent, or Firm* — Hunton Andrews Kurth LLP

(57) ABSTRACT

A illuminating body, which is part of a display device provided in a vehicle-mounted manipulation switch, is formed by bonding a first illuminating member and a second illuminating member together so as to form a clearance between the first illuminating member and the second illuminating member. The first illuminating member is made of a resin having high light permeability such as, for example, a milky synthetic resin. The second illuminating member is made of a resin having low light permeability. The synthetic resin of the second illuminating member is in a color similar to the color of the manipulation surface of the manipulation button. The color of the synthetic resin is, for example, a dim smoke color. The second illuminating member has a graphic display part fitted into the display window and also has a flange formed at the bottom end of the graphic display part.

4 Claims, 4 Drawing Sheets

DISPLAY DEVICE AND MANIPULATION SWITCH EQUIPPED WITH IT

CLAIM OF PRIORITY

This application contains subject matter related to and claims the benefit of Japanese Patent Application No. 2016-043919 filed on Mar. 7, 2016, the entire contents of which is incorporated herein by reference.

BACKGROUND OF THE DISCLOSURE

1. Field of the Disclosure

Embodiments of the present disclosure relate to a display device having an illuminating body that illuminates a display window provided in a main device body and to a manipulation switch equipped with the display device, and more particularly the embodiments of the present disclosure are applied to a vehicle-mounted manipulation switch.

2. Description of the Related Art

Conventionally, a manipulation button on a manipulation switch mounted in an automobile or the like has a display device that displays, for example, the turn-on and turn-off operations of the manipulation button in a switchable manner.

The above display device has an illuminating body that illuminates a display window formed in the manipulation body, which constitutes the main body of the display device. This type of illuminating body is often made of a resin in the same color as the surface of the manipulation button so that while the manipulation switch is not in use, the display window does not become outstanding and thereby the display device has an upscale appearance. Therefore, the resin of the illuminating body often is in a smoke color with low light permeability.

If, however, the illuminating body is made of a resin in a smoke color, while the manipulation switch is in use, the brightness of the illuminating body, which illuminates the display window, is lowered and the illumination of the display window becomes insufficient. This is problematic in that the display window cannot be visually recognized with ease.

In view of this situation, some manipulation switches have a display device in which an illuminating body is formed in double molding by bonding a first molding member, disposed close to a light source, which is made of a resin having high light permeability, and a second molding member, disposed close to a display window, which is made of a resin having low light permeability, the resin being in, for example, a smoke color. With the display device structured as described above, brightness with which the display window is illuminated is increased when compared with the display device having an illuminating body formed from only a resin in a smoke color, so the display window can be visually recognized with ease.

A related technique is disclosed in, for example, in Japanese Unexamined Patent Application Publication No. 10-116536.

The above illuminating body in the conventional display device has a structure in which a surface of the first molding member close to the light source and a surface of the second molding member close to the display window are bonded together directly in double molding. Therefore, these resins may be mixed on the bonded surfaces of the first illuminating member and second illuminating member, which may result in uneven bonding. If the bonded surface of each illuminating member is uneven, light directed to the display window does not diffuse. This has been problematic in the entire display window cannot be brightened.

These and other drawbacks exist.

SUMMARY OF THE DISCLOSURE

Embodiments of the present disclosure address the above situation by providing a display device having an illuminating body in which while the display device is not in use, the display window can be placed in a state in which the display window is not outstanding, and while the display device is in use, the display window can be illuminated with high brightness.

The embodiments of the present disclosure also provides a manipulation switch that has the display device described above.

A display device according to the present disclosure has an illuminating body that illuminates a display window formed in the main body of the display device; the illuminating body has a first illuminating member made of a resin having high light permeability, the first illuminating member being disposed close to a light source, and also has a second illuminating member made of a resin having low permeability, the second illuminating member being disposed close to the display window; the first illuminating member and second illuminating member are bonded together so that a clearance is formed between the first illuminating member and the second illuminating member at least in an optical path extending from the light source.

In this structure, while the display device is not in use, the display window can be placed in a state in which the display window is not outstanding, and while the display device is in use, the display window can be illuminated with high brightness.

The second illuminating member may be made of a resin in a color similar to the color of the surface of the main body of the display device.

In this structure, while the display device is not in use, the display window can be placed in a state in which the display window is not outstanding, enabling the display device to have an upscale appearance.

An inclined surface or curved surface used to diffuse light may be formed on a surface of the first illuminating member in the optical path, the surface facing the second illuminating member.

In this structure, it is possible to increase the intensity of light exiting from the first illuminating member.

An inclined surface or curved surface used to condense light may be formed on a surface of the second illuminating member in the optical path, the surface facing the first illuminating member.

In this structure, it is possible to condense light diffused by the first illuminating member so that the condensed light is incident on the second illuminating member, enabling the intensity of the light to be maintained.

The second illuminating member has a graphic display part having the same shape as the display window and also has a flange integrally formed at the bottom end of the graphic display part, the flange being attached to the rear surface of the main body of the display device.

In this structure, the inside of the main body of the display device is not exposed from the display window, preventing the appearance of the display device from being impaired. It is also possible to prevent water from entering the inside of the display device.

A manipulation switch according to the present disclosure has the display device described above.

In this structure, while the manipulation switch is not in use, the display window can be placed in a state in which the display window is not outstanding, and while the manipulation switch is in use, the display window can be illuminated with high brightness.

The embodiments of the present disclosure can provide a display device having an illuminating body in which while the display device is not in use, a display part can be in a dim color, and while the display device in use, the display part can be illuminated with high brightness.

The embodiments of the present disclosure also can provide a manipulation switch that has the display device described above.

DETAILED DESCRIPTION OF THE DISCLOSURE

The following description is intended to convey a thorough understanding of the embodiments described by providing a number of specific embodiments and details involving a display device and manipulation. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

An example embodiment of the present disclosure will be described below with reference to the drawings.

Figure 1:
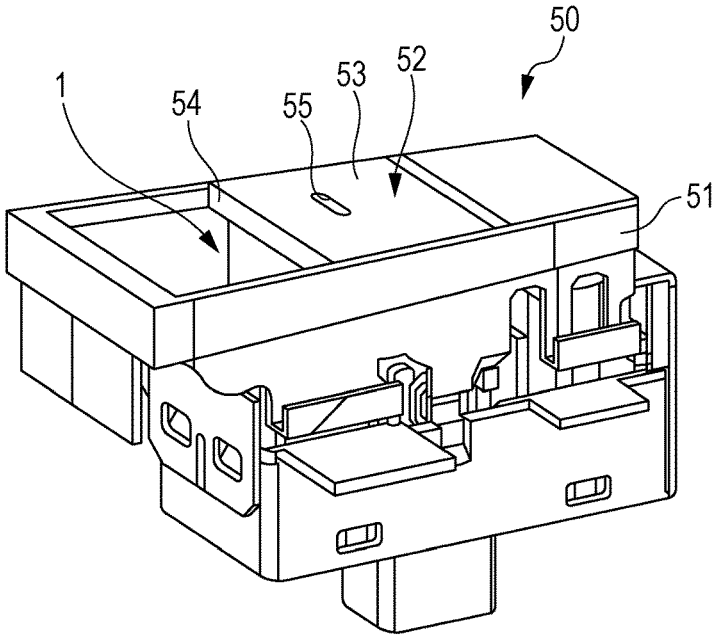
FIG. 1 is a perspective view of a vehicle-mounted manipulation switch according to an example embodiment of the present disclosure.
Figure 2:
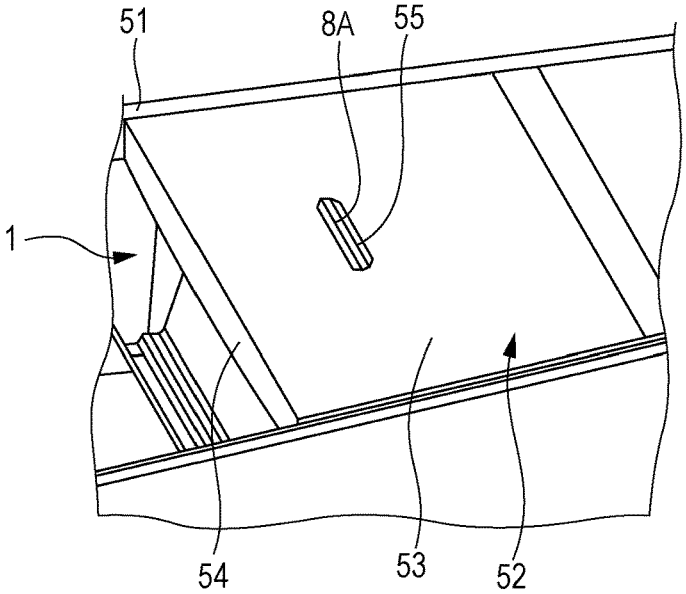
FIG. 2 is an enlarged perspective view of part of a manipulation button included in the vehicle-mounted manipulation switch.
Figure 3:
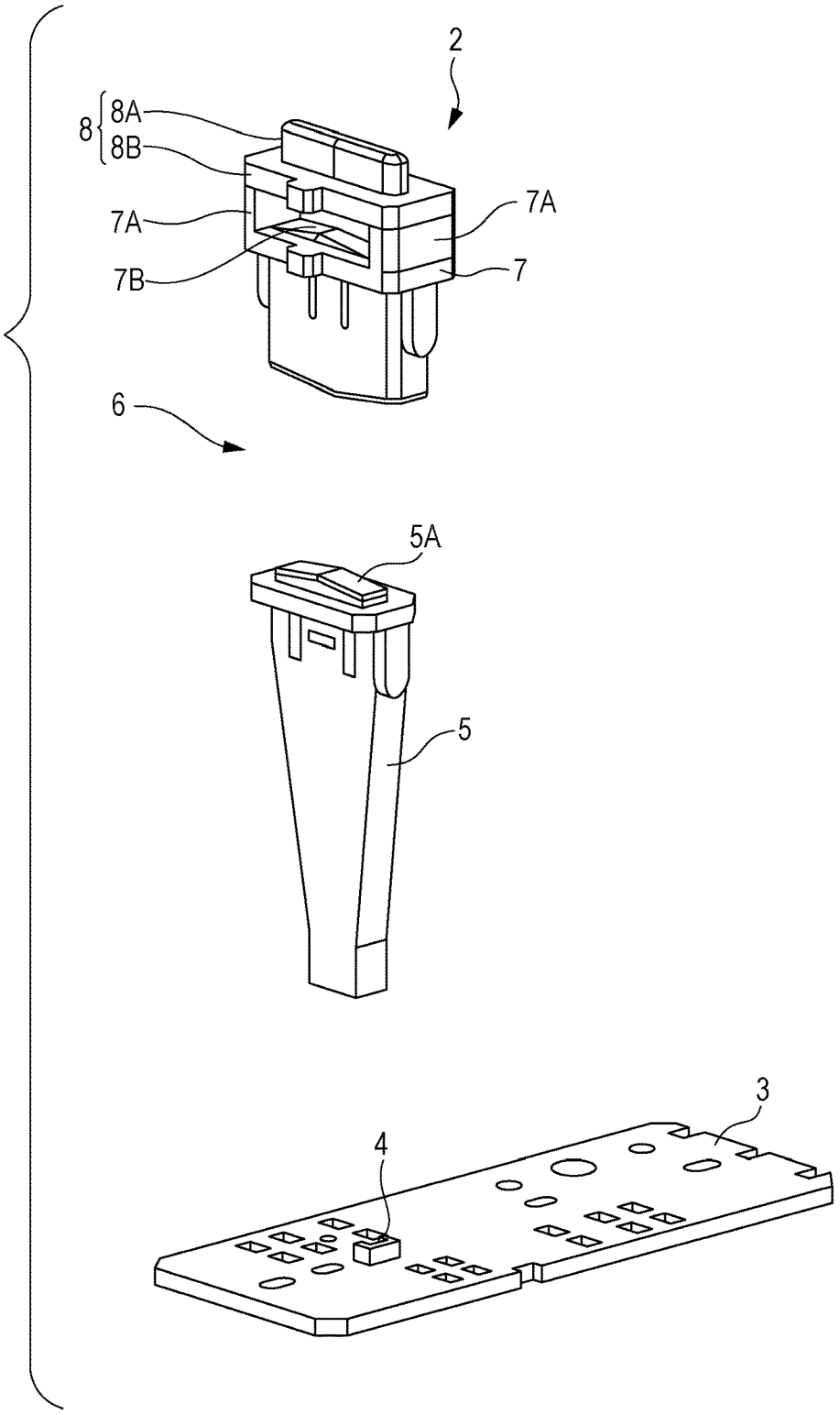
FIG. 3 is an exploded perspective view illustrating the inside of the vehicle-mounted manipulation switch.
Figure 4:
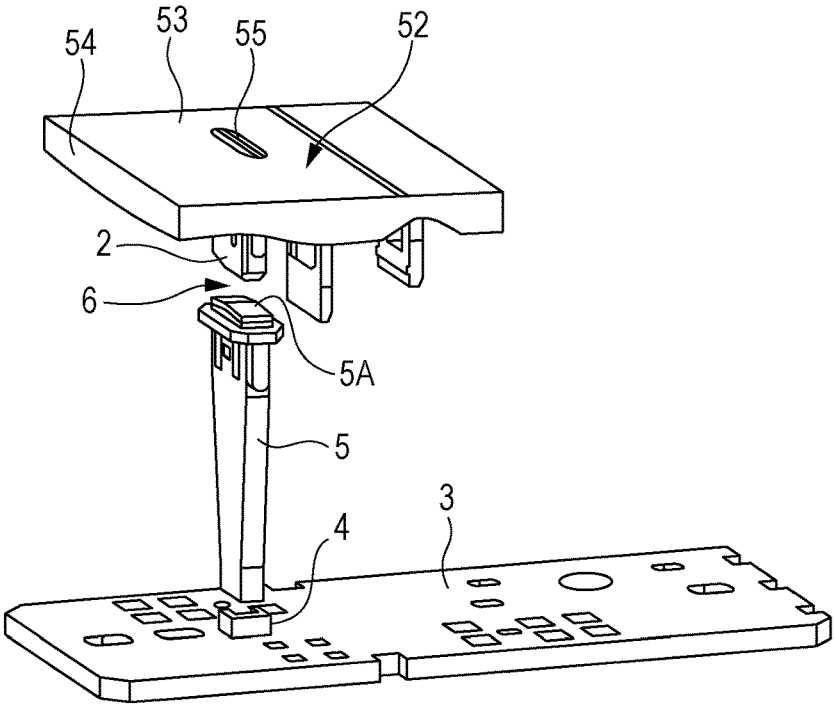
FIG. 4 is an exploded perspective view illustrating parts forming an optical path included in the display device.
Figure 5:
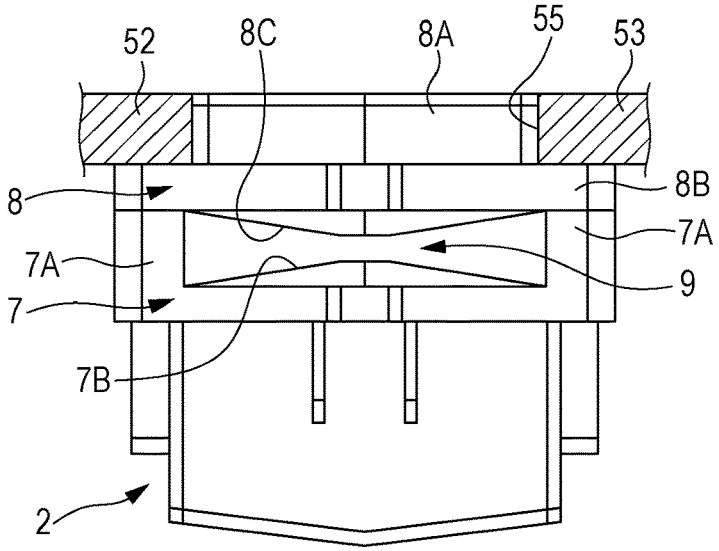
FIG. 5 is an enlarged cross-sectional view illustrating a structure in which an illuminating body included in the display device is attached to the manipulation button.

FIG. 1 is a perspective view of a vehicle-mounted manipulation switch according to an example embodiment of the present disclosure. FIG. 2 is an enlarged perspective view of part of a manipulation button included in the vehicle-mounted manipulation switch. FIG. 3 is an exploded perspective view illustrating the inside of the vehicle-mounted manipulation switch. FIG. 4 is an exploded perspective view illustrating parts forming an optical path included in the display device. FIG. 5 is an enlarged cross-sectional view illustrating a structure in which an illuminating body included in the display device is attached to the manipulation button.

As illustrated in FIG. 1, a vehicle-mounted manipulation switch 50 may have a case 51 and a manipulation button 52, which may be swingably incorporated into the case 51. When the manipulation button 52 is pressed, the vehicle-mounted manipulation switch 50 is turned on. When a hook 54 formed in front of the manipulation button 52 is lifted, the vehicle-mounted manipulation switch 50 is turned off.

A display device 1 may be incorporated into the vehicle-mounted manipulation switch 50. The manipulation button 52 constitutes the main body of the display device 1. A display window 55 may be formed in the manipulation button 52 as illustrated in FIG. 2. The display window 55 displays the turn-on and turn-off operations of the vehicle-mounted manipulation switch 50. The display window 55 may have the same shape as a graphic display part 8A included in an illuminating body 2, which will be described later.

In the case 51 of the vehicle-mounted manipulation switch 50, the illuminating body 2, which is part of the display device 1, may be attached to the rear surface of the manipulation button 52 so as to face the display window 55, as illustrated in FIG. 3.

The illuminating body 2 may be disposed in the optical path of a light-emitting diode (LED) 4, which is a light source, mounted on a circuit board 3 incorporated into the case 51. In the case 51, an elongated light guiding member 5 made of a transparent or milky synthetic resin may be incorporated in the optical path between the LED 4 and the illuminating body 2. A clearance 6 is formed between the light guiding member 5 and the illuminating body 2 so that when the manipulation button 52 is pressed, the illuminating body 2 does not abut the upper end of the light guiding member 5.

An inclined surface 5A shaped like an umbrella may be formed on the upper end surface of the light guiding member 5 so as to protrude as illustrated in FIG. 4. The inclined surface 5A diffuses light incident on it from the LED 4.

In the illuminating body 2, a first illuminating member 7 disposed close to the light guiding member 5, which may be disposed close to the LED 4, and a second illuminating member 8 disposed close to the display window 55 are bonded together so that a clearance 9 is formed in the light path between the first illuminating member 7 and the second illuminating member 8, as illustrated in FIG. 5. The first illuminating member 7 and second illuminating member 8 may be formed in double molding.

The first illuminating member 7 is made of a resin having high light permeability such as, for example, a milky synthetic resin. Legs 7A may be formed at both ends of the first illuminating member 7.

The second illuminating member 8 may be made of a resin having low light permeability. In this embodiment, the manipulation surface 53 of the manipulation button 52 may be in a smoke color. Therefore, the synthetic resin of the second illuminating member 8 may be in a dim smoke color similar to the color of the manipulation surface 53 of the manipulation button 52.

The second illuminating member 8 may have a graphic display part 8A fitted into the display window 55 and also may have a flange 8B formed at the bottom end of the graphic display part 8A.

The lower surface of the flange 8B abuts the legs 7A of the first illuminating member 7, and the second illuminating member 8 is supported by the first illuminating member 7.

The flange 8B may be attached to the rear surface of the manipulation button 52, and the whole of the illuminating body 2 may be integrally attached to and supported by the manipulation button 52.

An inclined surface 7B shaped like an umbrella may be formed on the upper surface of the first illuminating member 7, the upper surface facing the second illuminating member 8, so as to protrude. The inclined surface 7B may diffus light incident on it through the light guiding member 5.

Similarly, an inclined surface 8C shaped like an umbrella may be formed on the lower surface of the second illuminating member 8, the lower surface facing the first illuminating member 7, so as to protrude. The inclined surface 8C may condens light incident on it through the first illuminating member 7.

Figure 6:
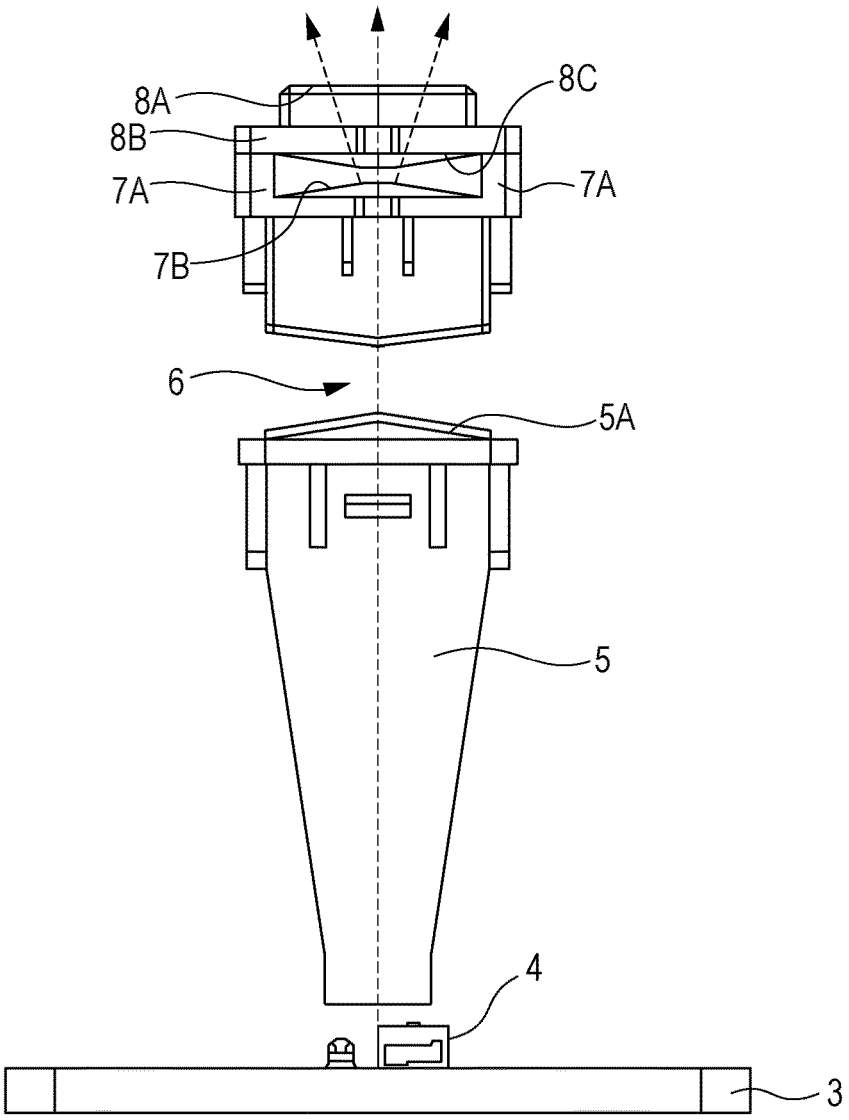
FIG. 6 is a front view illustrating the optical path in the display device.

The functions of the illuminating body 2 will be described with reference to FIG. 6.

The LED 4, which is the light source of the display device 1, may be mounted on the circuit board 3 incorporated in the case 51 of the vehicle-mounted manipulation switch 50. Light emitted from the LED 4 passes through the light guiding member 5 and enters the first illuminating member 7, as indicated by a dashed line in FIG. 6.

Since the first illuminating member 7 is made of a synthetic resin having high light permeability, light incident on the first illuminating member 7 exits with high brightness. The light exiting from the first illuminating member 7 is diffused by the inclined surface 7B as indicated by the arrows, drawn in dashed lines, in FIG. 6, and is then led to the second illuminating member 8.

The light exiting from the first illuminating member 7 enters the second illuminating member 8. The light to be incident on the second illuminating member 8 is condensed by the inclined surface 8C and enters the second illuminating member 8.

Since the clearance 9 is formed between the first illuminating member 7 and the second illuminating member 8, even if the first illuminating member 7 and second illuminating member 8 are formed in double modeling as in the past, the resins are not mixed between the first illuminating member 7 and second illuminating member 8 in the light path. Light exiting from the first illuminating member 7 is diffused while the intensity of the light is maintained at a high level, and the diffused light enters the second illuminating member 8. Therefore, it is possible to illuminate the display window 55 with high brightness.

As described above, in this embodiment, the graphic display part 8A, facing the display window 55 in the manipulation button 52, of the illuminating body 2 may be in a smoke color similar to the color of the manipulation surface 53 of the manipulation button 52. Therefore, while the vehicle-mounted manipulation switch 50 is not in use, the color of the illuminating body 2 exposed from the display window 55 matches the color of the manipulation surface 53, and the illuminating body 2 does not become outstanding. This enables the display device 1 to have an upscale appearance.

While the vehicle-mounted manipulation switch 50 is in use, the graphic display part 8A may be clearly illuminated with high brightness. Therefore, even if the vehicle-mounted manipulation switch 50 is disposed at a distance from the driver, the driver can visually recognize the turned-on state of the vehicle-mounted manipulation switch 50.

Since the width of the graphic display part 8A of the second illuminating member 8 is smaller than the distance between the legs 7A of the first illuminating member 7, it is possible to illuminate the whole of the graphic display part 8A with high brightness.

Since the flange 8B is attached to the rear surface of the manipulation button 52, the inside of the vehicle-mounted manipulation switch 50 is not exposed from the display window 55, preventing the appearance of the vehicle-mounted manipulation switch 50 from being impaired. Since the opening of the display window 55 can be covered with the flange 8B, it is also possible to prevent water from entering the inside of the vehicle-mounted manipulation switch 50 through the display window 55.

The present disclosure is not limited to the example embodiment described above. That is, a person having ordinary skill in the art may make various modifications, combinations, sub-combinations, and replacements for the constituent elements in the above embodiment, without departing from the technical range of the present invention or an equivalent range of the technical range.

Although, in this embodiment, a milky resin has been used as the molding material of the first illuminating member 7, this is not a limitation. In various embodiments of the present disclosure, it is only necessary to form the first illuminating member 7 from a resin having high light permeability. The first illuminating member 7 may be made of a transparent resin.

Although, in this embodiment, an example has been described in which a resin in a smoke color similar to the color of the manipulation surface 53 of the manipulation button 52 is used as the molding material of the second illuminating member 8, this is not a limitation. According to embodiments of the present disclosure, it is only necessary to form the second illuminating member 8 with a resin that is in a dim color and has low light permeability.

Although, in this embodiment, an example has been described in which the graphic display part 8A of the second illuminating member 8 is fitted directly to the display window 55, this is not a limitation. In the present disclosure, the display window 55 may be buried into a transparent resin and the second illuminating member 8 may be attached to the manipulation button 52 so that the graphic display part 8A faces the display window 55 from below.

Although, in this embodiment, an example has been described in which the inclined surface 7B shaped like an umbrella is formed on the upper surface of the first illuminating member 7, the upper surface facing the second illuminating member 8, so as to protrude and diffuse light that enters the first illuminating member 7 through the light guiding member 5, this is not a limitation. A protrusion with a curved surface may be formed instead of the inclined surface 7B shaped like an umbrella. Although, in this embodiment, an example has been described in which the inclined surface 8C shaped like an umbrella is formed on the lower surface of the second illuminating member 8, the lower surface facing the first illuminating member 7, so as to protrude and condense light that enters second illuminating member 8 through the first illuminating member 7, this is not a limitation. A protrusion with a curved surface may be formed instead of the inclined surface 8C shaped like an umbrella.

Although, in this embodiment, an example has been described in which the display device 1 is incorporated into the vehicle-mounted manipulation switch 50, this is not a limitation. The display device 1 according to the present disclosure may be incorporated into the display panel of an electronic device that has only a display function.

The examples in the present disclosure can be applied to a display device having an illuminating body.

Accordingly, the embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A manipulation switch, comprising:

a case;

a manipulation button that is movably fixed to the case, the manipulation button having a display window;

an illuminating body that is affixed to the manipulation button and illuminates the display window of the manipulation button; and a light source; wherein the illuminating body has a first illuminating member made of a resin having high light permeability, the first illuminating member being disposed close to the light source, and a second illuminating member made of a resin having low permeability, the second illuminating member being disposed close to the display window, a light guiding member is incorporated in the optical path between the light source and the illuminating body; and the first illuminating member and the second illuminating member are integrally formed together so that a first clearance is formed between the first illuminating member and the second illuminating member at least in an optical path extending from the light source, and a second clearance is formed between the light guiding member and the illuminating body so that when the manipulation button is pressed, the illuminating body does not abut the upper end of the light guiding member, and wherein the first illuminating member and the second illuminating member are formed in double molding and integrally connected to each other by legs integrally formed at position that is not on the optical path, an inclined surface or a curved surface that is used to diffuse light is formed on a surface of the first illuminating member in the optical path, the surface facing the second illuminating member, and an inclined surface or a curved surface that is used to condense light is formed on a surface of the second illuminating member in the optical path, the surface facing the first illuminating member.

2. The manipulation switch according to claim 1, wherein the second illuminating member is made of a resin in a color similar to a color of a surface of the manipulation button.

3. The manipulation switch according to claim 1, wherein the second illuminating member has a graphic display part having the same shape as the display window, and a flange integrally formed at a bottom end of the graphic display part, the flange being attached to a rear surface of the manipulation button of the manipulation switch.

4. The manipulation switch according to claim 1, wherein:

the manipulation button is swingably incorporated into the case, and an inclined surface is formed on the upper end surface of the light guiding member.

* * * * *